United States Patent [19]

Benda

[11] 4,018,332

[45] Apr. 19, 1977

[54] KIT FOR RENOVATING A PLANAR SURFACE

[75] Inventor: George Benda, Islington, Canada

[73] Assignee: Lawrence Peska Associates, Inc., New York, N.Y. ; a part interest

[22] Filed: Aug. 21, 1975

[21] Appl. No.: 606,554

[52] U.S. Cl. ..... 206/223; 206/45.14

[51] Int. Cl.[2] ..... B65D 69/00

[58] Field of Search ..... 206/223, 225, 224, 45.14

[56] References Cited

UNITED STATES PATENTS

| | | | |
|---|---|---|---|
| 3,802,555 | 4/1974 | Grasty et al. | 206/223 |
| 3,840,113 | 10/1974 | Bartleson | 206/223 |
| 3,851,649 | 12/1974 | Villari | 206/223 |
| 3,889,806 | 6/1975 | Casella | 206/223 |

*Primary Examiner*—Stephen P. Garbe
*Assistant Examiner*—Joseph M. Moy

[57] ABSTRACT

A kit for renovating a planar surface such as a door, wall, or cabinet includes a case, a roll of plastic having an adhesive backing and a wood patterned front face which adhers onto the door, a plurality of geometrically shaped members which affix onto the wood pattern front face, graph paper, pencils, paint, finish, brushes, and a ruler.

5 Claims, 3 Drawing Figures

KIT FOR RENOVATING A PLANAR SURFACE

BACKGROUND OF THE INVENTION

U.S. Pat. No. 3,389,505 to Zitomer involves a frame construction for storm and screen doors, wherein a decorative panel is contained on the door. U.S. Pat. No. 3,404,502 to Miller teaches a method of making a hollow panel appearance on a door, wherein a decorative fixture is adapted to be disposed in an aperture in the door. U.S. Pat. No. 3,584,427 relates to an ornamental shutter adapted to be secured to a wall adjacent to a window. These aforementioned patents are non-applicable to my present invention which provides a means for renovating a planar surface.

SUMMARY OF THE INVENTION

My present invention relates to a unique and novel means of renovating a planar surface into a luxurious wood pattern having a panel like design thereon.

An object of my present invention is to provide a kit for renovating a planar surface such as a door, a wall or a cabinet into a luxurious wood pattern having a panel like effect, wherein the kit is readily used by the ordinary layman.

Briefly my present invention comprises a case, a roll of plastic having an adhesive backing and a wood patterned front face which adhers onto the door, a plurality of geometrically shaped members which affix onto the wood pattern front face, graph paper, pencils, paint, finish, brushes, and a ruler.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
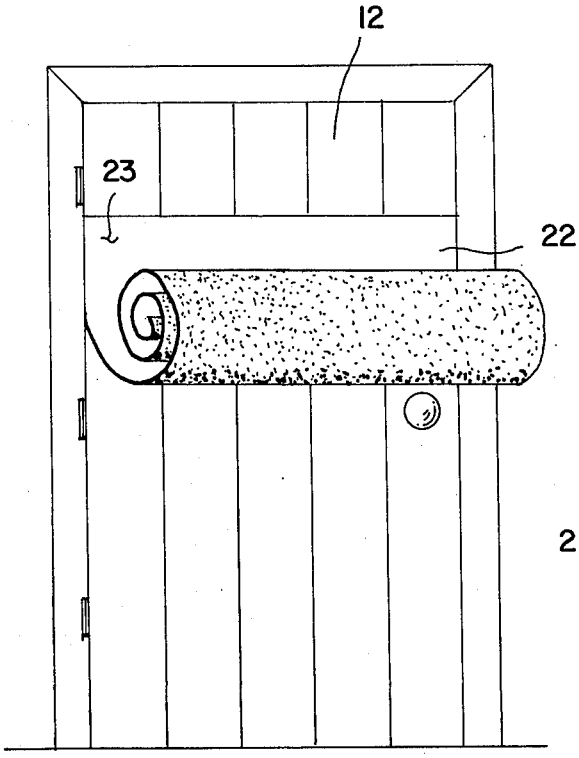
FIG. 1 illustrates a front perspective view of a roll of plastic of the kit being applied to a door.
Figure 2:
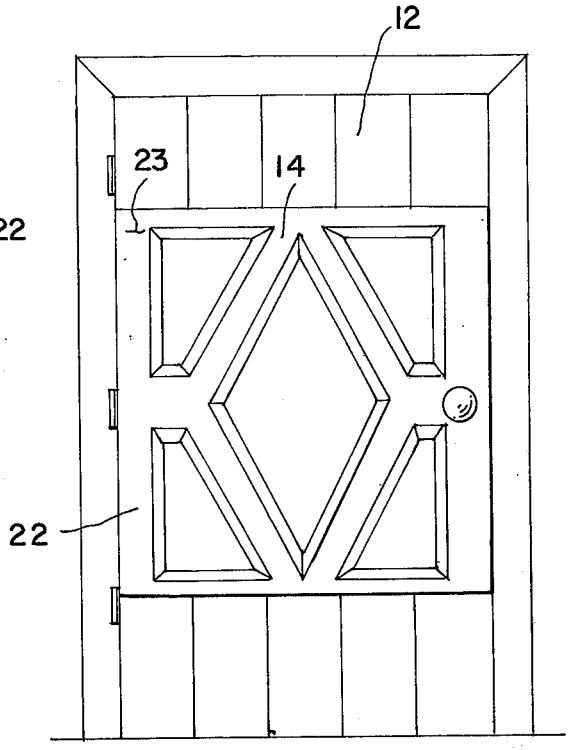
FIG. 2 illustrates a front perspective view of the door which has been renovated with the kit.
Figure 3:
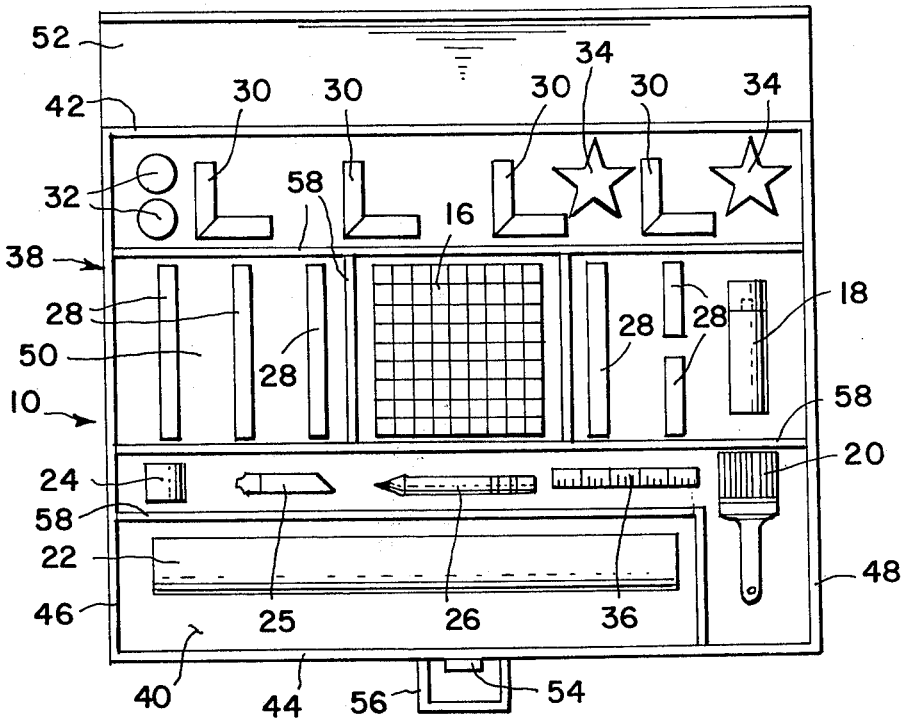
FIG. 3 illustrates a top perspective view of the components of the kit contained in a case.

Turning now descriptively to the drawings, in which similar reference characters denote similar elements throughout the several views, FIG. 3 shows the component parts of a kit 10 used to renovate an old door 12 as shown in FIGS. 1, 2 whereby a design pattern 14 is formed on the door 12. Old doors 12 many times become scratched or marred and need to be refinished. With the kit 10 of the present instant invention, the old door 12 or even a new door can be redesigned into a luxurious looking door. The kit 10 comprises the following components; graph paper 16, a can of paint 18, brushes 20, a roll of adhesive backed vinyl plastic 22, having a wood pattern on its front face 23, a can of finish 24, a knive 25, pencils 26, a ruler 36, a plurality of elongated shaped members 28, a plurality of right angle shaped members 30, a plurality of circular shaped members 32, and a plurality of star-shaped members 34. Members 28, 30, 32, 34 have an adhesive backing thereon, thereby allowing them to be affixed onto the front wood patterned face 23 of the plastic 22 so as to simulate a raised surface in a predetermined pattern as shown in FIG. 2. A plurality of patterns or designs can be formed depending on the arrangement of the members 28, 30, 32, 34 on the plastic 22.

In use, the roll of plastic 22 is unrolled and the plastic is adhered to the door 12 as shown in FIG. 1. A pattern is outlined on the front face 23 of the plastic 22 which is affixed to the door 12 by means of the graph paper 16 and pencil 26. The members 28, 30, 32, 34 are affixed to the front face 23 of the plastic 22. The paint 18 is applied with the brush 20 to the members 28, 30, 32, 34. After the paint 18 has dried, a finish 24 is applied by means of brushing. The members 28, 30, 32, 34 are formed from a wood-like substance or a pigment plastic such as polyethylene, polypropylene, polyvinyl chloride, polyester, or polyurethane. The plastic substance can also be foamed, thereby imparting a grain like finish.

This kit 10 is also readily adapted to be used as interior paneling in a house, or in the manufacturing of cabinets.

Referring back to FIG. 3, the components of the kit 10 are stored in a case 38. The case 38 comprises a base 40, four upwardly extending walls 42, 44, 46, 48 thereby describing a compartment 50 therein. A cover 52 is hingably mounted onto an upper edge of one wall 42. A lock means 54 is contained in another wall 44 for locking closed the cover. A handle member 56 is joined to the outside surface of the wall 44 thereby permitting the case 38 to be easily carried. A plurality of upwardly extending intermediate walls 58 are contained within compartment 50, thereby forming a plurality of subcompartments for holding the components of the kit 10.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by letters patent of the United States is:

1. A kit for renovating a planar surface, which comprises:

a. a knife b. a roll of plastic material having an adhesive backing and a wood patterned front face, a sheet of said plastic material cut from said roll with said knife, said sheet of said plastic material affixed onto said planar surface by means of said adhesive backing;

c. graph paper; said graph paper removably placed on said front face of said plastic material;

d. at least one pencil, said pencil outlining at least one pattern onto said front face of said plastic material around said graph paper said graph paper being cut by said knife into a plurality of shapes, said graph paper being removed from said front face of said plastic material after formation of said outline of said pattern;

e. a plurality of geometrically shaped members, each said member having an adhesive backing thereon, said geometrically shaped members being affixed onto said front face of said plastic material in a predetermined arrangement within said outlines of said patterns;

f. at least one paint brush;

g. a quantity of paint, said paint applied onto to said geometrically shaped members with said paint brush; and h. a quantity of finish, said finish applied onto said paint coated on said geometrically shaped members with said paint brush.

2. A kit according to claim 1, wherein a case is provided for holding the individual components of said kit.

3. A kit according to claim 1, wherein said geometrically shaped members are: elongated, right angled, circular, and star-shaped in configuration.

4. A kit according to claim 3, wherein said geometrically shaped members are formed from wood.

5. A kit according to claim 3, wherein said geometrically shaped members are formed from a thermo plastic selected from the group consisting of polyethylene, polypropylene, polyester, polyurethane, or polyvinyl chloride.

* * * * *